US006074248A

United States Patent [19]

Huang

[11] Patent Number: 6,074,248

[45] Date of Patent: Jun. 13, 2000

[54] MOUNTING BRACKET FOR ARRANGING DIFFERENT CONNECTORS

[75] Inventor: Wayne Huang, Alhambra, Calif.

[73] Assignee: Hon Hai Precision Ind. Co., Ltd., Taipei Hsien, Taiwan

[21] Appl. No.: 09/176,384

[22] Filed: Oct. 21, 1998

[51] Int. Cl.[7] ..... H01R 13/66; H01R 13/60

[52] U.S. Cl. ..... 439/541.5

[58] Field of Search ..... 439/541.5, 567

[56] References Cited

U.S. PATENT DOCUMENTS 5,085,590 2/1992 Galloway ..... 439/95

5,267,876 12/1993 Rupert ..... 439/541.5

*Primary Examiner*—Khiem Nguyen

*Assistant Examiner*—Javaid Nasri

*Attorney, Agent, or Firm*—Wei Te Chung

[57] ABSTRACT

A mounting bracket for assembling connectors comprises a body including a pair of side stands connected by a vertical bar and a horizontal bar. A pair of mounting lugs extends upward from the side stands and defines a first receiving space with a top face of the vertical bar for receiving a first connector therein. A second receiving space for receiving a second connector is defined between a bottom face of the vertical bar and an inner wall of the horizontal bar. Each mounting lug defines a through hole for riveting the first connector thereto. The second receiving space forms at least an embossment for detachably engaging with a recess of the second connector.

7 Claims, 5 Drawing Sheets

MOUNTING BRACKET FOR ARRANGING DIFFERENT CONNECTORS

FIELD OF THE INVENTION

The present invention relates to a mounting bracket, and more particularly, to a mounting bracket for arranging connectors at different levels.

DESCRIPTION OF PRIOR ART

I/O (input/output) port connectors are mounted on a back panel of a computer housing for facilitating signal communication between the computer system and different peripherals, such as a printer. As the computer becomes more and more complex, many devices which previously installed outside the computer housing and connected with the system through cables are now becoming a built-in standard. For example, a modem has become standard equipment for notebook and desktop computers. However, once an electrical device has been installed a related port must be designated. This raises difficulties since space on both a motherboard and a back panel of the computer are limited.

I/O connectors have a connecting portion which is assembled to a motherboard of the computer and contact tails thereof are electrically soldered to the motherboard. A mating portion of the I/O connector projects into an opening on the back panel of a computer for electrically connecting with a mating connector assembled thereto. Available space for mounting such I/O connectors is reduced because an increasing number of devices require a designated I/O port connector. This problem becomes magnified for notebook computers.

Many approaches have been introduced to address this problem by stacking similar connectors together. U.S. Pat. Nos. 5,037,330, 5,080,609, 5,085,590 and 5,336,109 disclose an arrangement of stacking an upper connector and a lower connector by means of a frame. Various connectors have been developed in recent years for different applications. The assembly different connectors within a limited space and area has become a significant design concern.

SUMMARY OF THE INVENTION

An objective of this invention is to provide a mounting bracket for assembling two connectors at different levels.

An additional objective of this invention is to provide a mounting bracket for easily and efficiently arranging connectors at different levels.

In order to facilitate the objectives set forth, a mounting bracket for assembling connectors comprises a body including a pair of side stands connected by a vertical bar and a horizontal bar. A pair of mounting lugs extend upward from the side stands and defines a first receiving space with a top face of the vertical bar for receiving a first connector therein. A second receiving space for receiving a second connector is defined between a bottom face of the vertical bar and an inner wall of the horizontal bar. Each mounting lug defines a through hole for riveting the first connector thereto. The vertical bar forms three embossments extending toward the second receiving space from the bottom face for detachably engaging with a recess of the second connector.

These and additional objects, features, and advantages of the present invention will become apparent after reading the following detailed description of the preferred embodiment of the invention taken in conjunction with the appended drawings.

DETAILED DESCRIPTION OF PREFERRED EMBODIMENT

Figure 1:
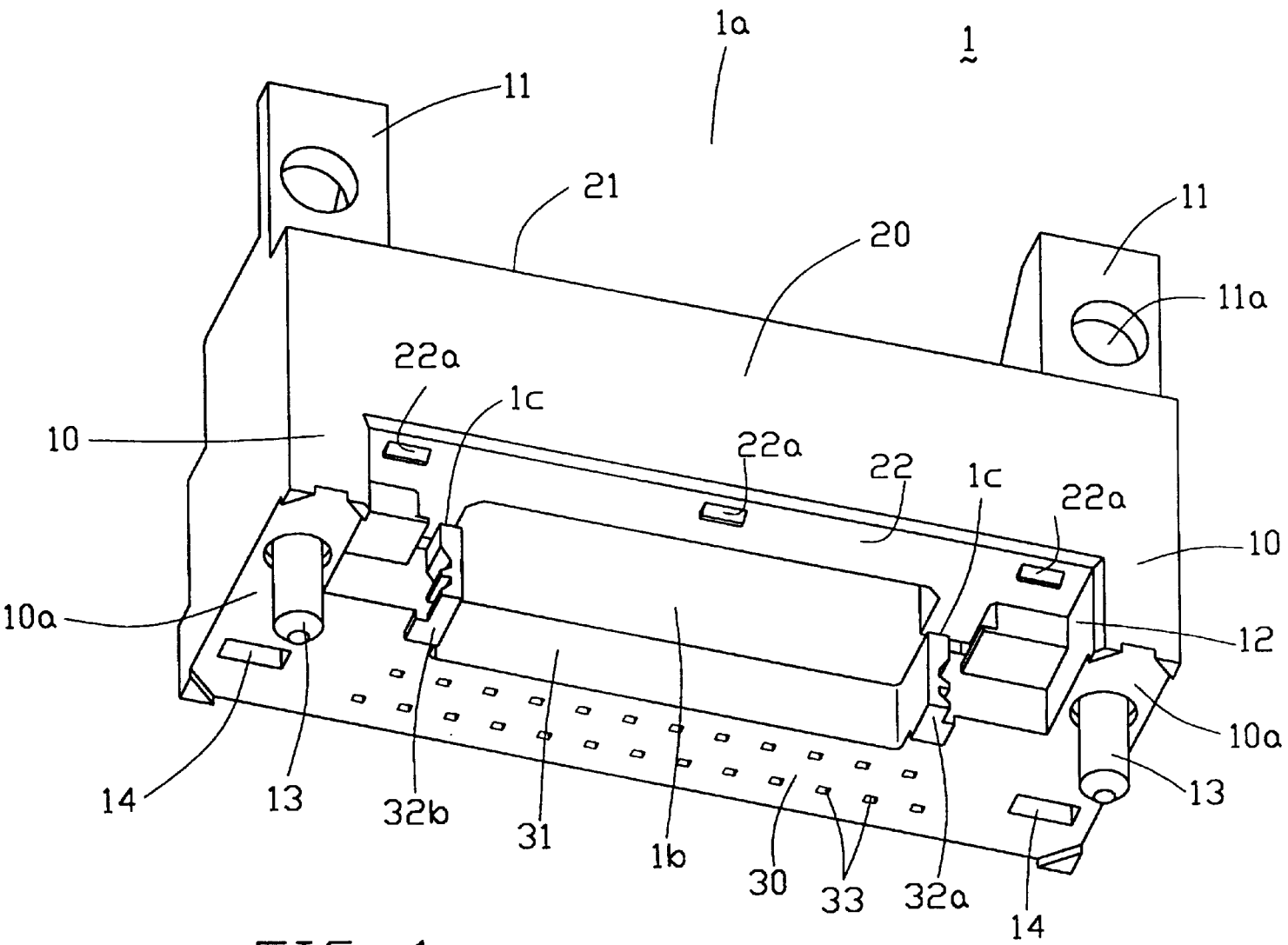
FIG. 1 is a perspective view of a first embodiment of a mounting bracket in accordance with the present invention.
Figure 2:
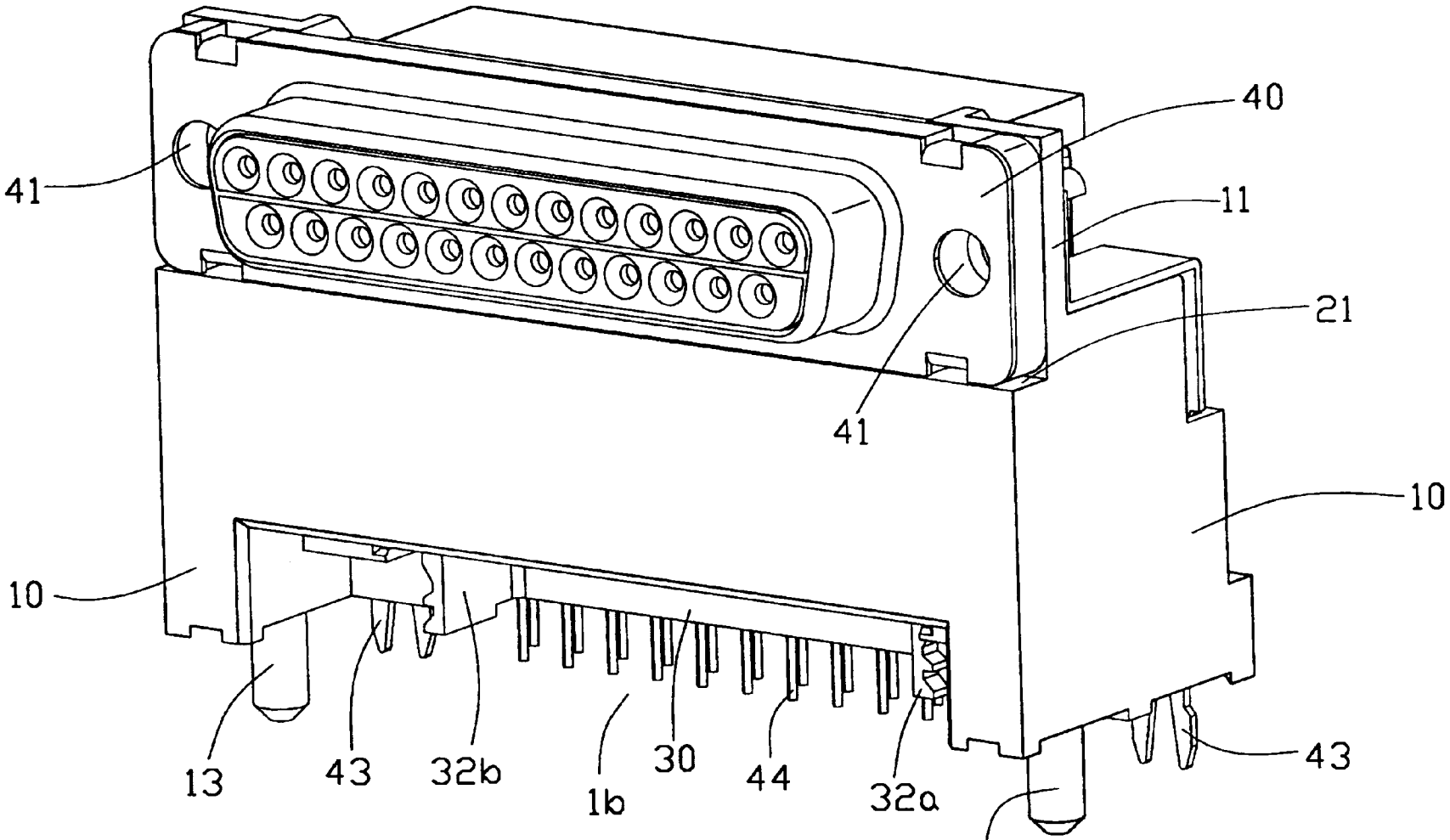
FIG. 2 is a perspective view of the mounting bracket with a first connector assembled thereto.
Figure 4:
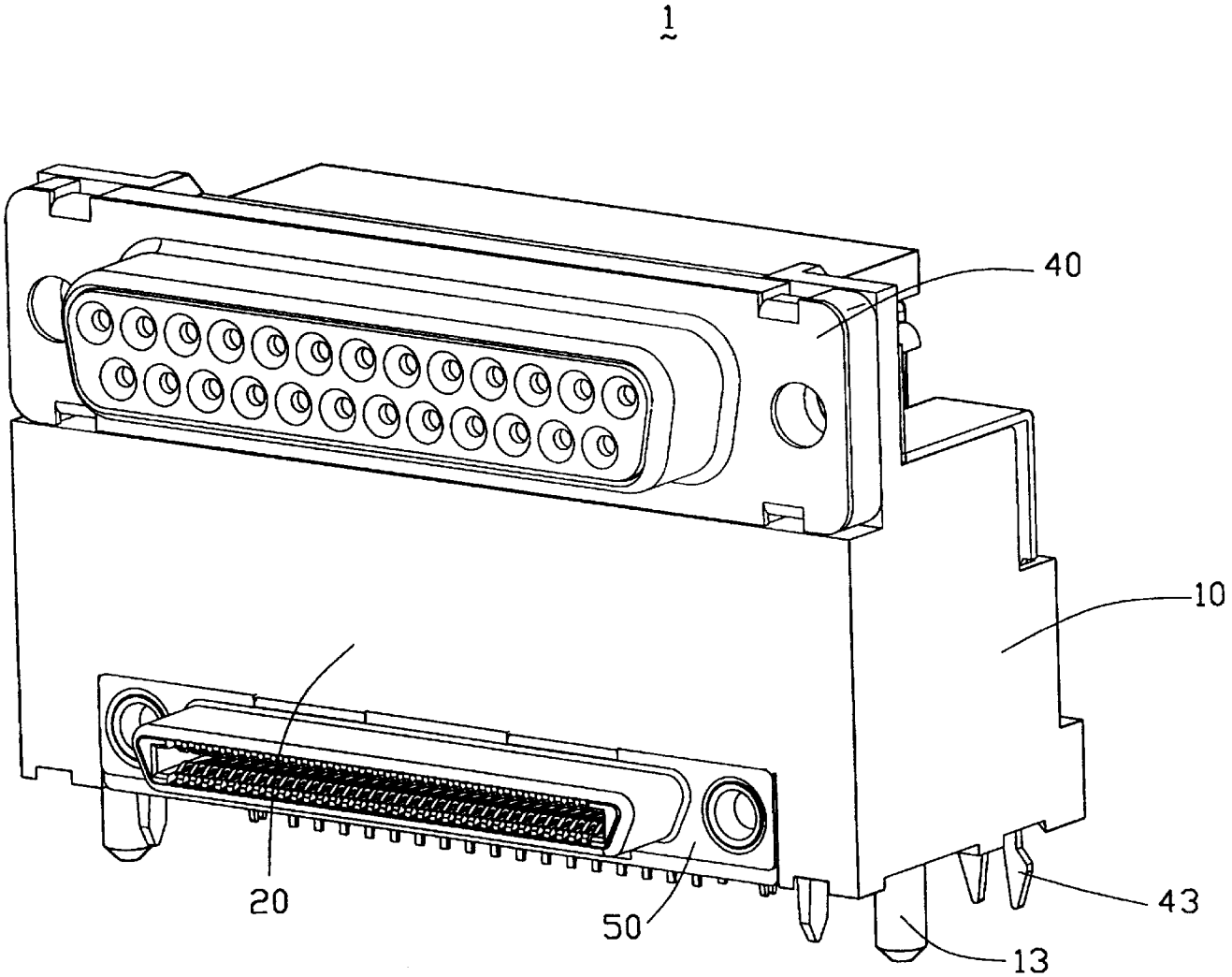

Referring to FIGS. 1 and 2, a mounting bracket 1 in accordance with the present invention comprises a pair of side stands 10 connected between a vertical bar 20 and a horizontal bar 30. Each stand 10 forms a mounting lug 11 extending from a top face thereof and defining a through hole 11*a* therethrough. A passage 14 is defined in each stand 10 through which a board lock 43 of a first connector 40 extends. A first receiving space 1*a* is defined between a top face 21 of the vertical bar 20 and the mounting lugs 11 for receiving the first connector 40 therein. A second receiving space 1*b* is defined between a bottom face 22 of the vertical bar 20 and inner walls 31, 12 of the horizontal bar 30 and stand 10, respectively, for receiving a second connector 50 therein (FIG. 4). Each stand 10 forms a post 13 extending from a bottom face 10*a* thereof for alignment with a mounting hole of a motherboard (not shown). The vertical bar 20 forms three embossments 22*a* extending into the second receiving space 1*b* from the bottom face 22 thereof.

A pair of anti-disorientation tabs 32*a*, 32*b* extend from the inner wall 31 of the horizontal bar 30. The length of the anti-disorientation tabs 32*a*, 32*b* is different to ensure correct insertion of the second connector 50. A retaining slot 1*c* is defined between each anti-disorientation tab 32*a*, 32*b* and the bottom face 22 of the vertical bar 20 for retaining a portion of the second connector 50 thereby limiting downward movement of the second connector 50. The horizontal bar 30 defines an array of through holes 33 for alignment with contact tails 44 of the first connector 40. The first connector 40 is firmly supported and received within the first receiving space 11*a*. A hole 41 of the first connector 40 aligns with the through hole 11*a* for riveting the first connector 40 to the mounting lugs 11.

Figure 3:
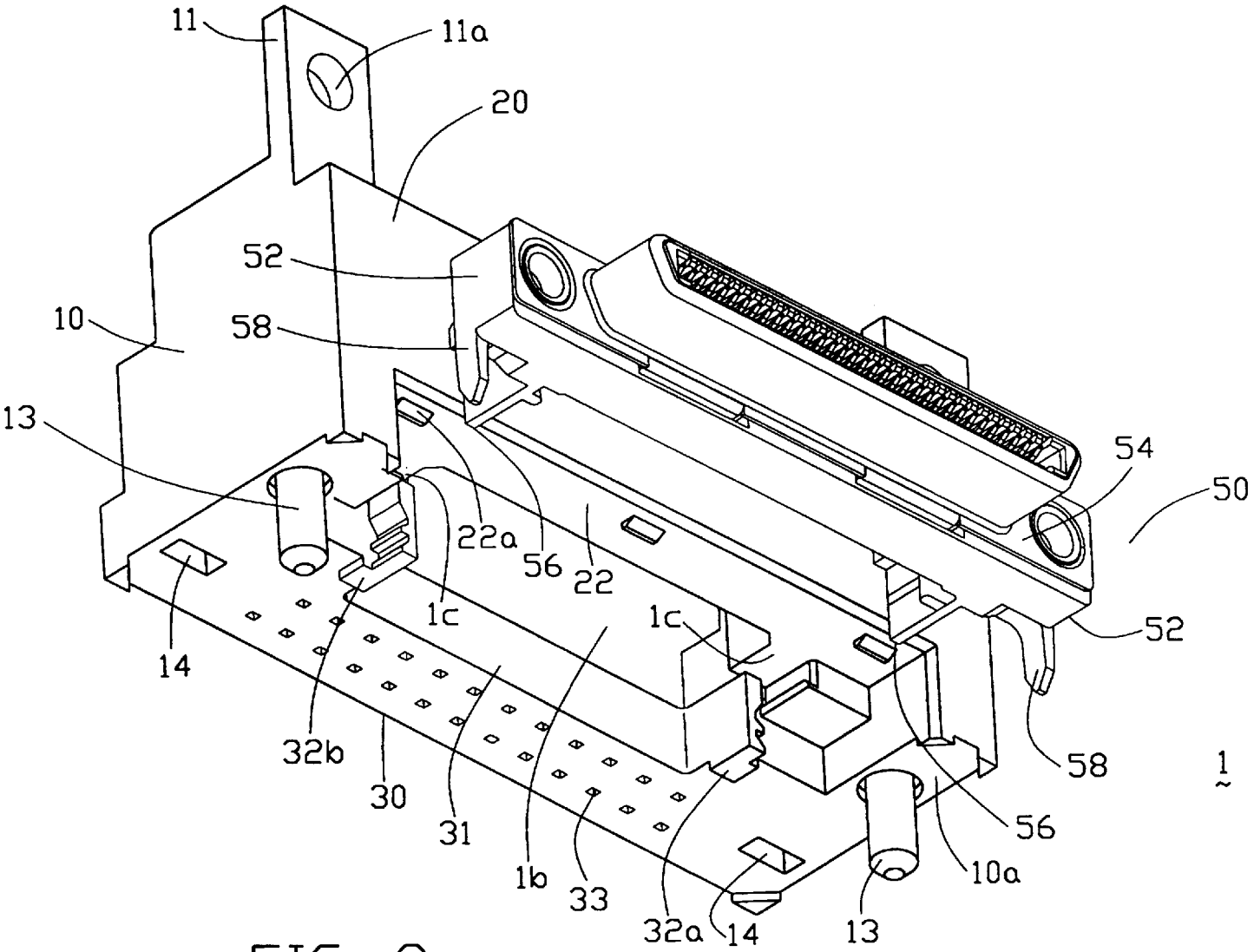
FIG. 3 is a perspective view of the mounting bracket with a second connector assembled thereof wherein the contacts of the second connector have and FIG. 4 is a perspective view of the mounting bracket with first and second connectors assembled thereto.

In FIG. 3. a second connector 50 is received in the second receiving space 1*b* of the mounting bracket 1. In assembly, portions of the second connector 50 are aligned with the anti-disorientation tabs 32*a*, 32*b* and then inserted into the second receiving space 1*b*. The second connector 50 is then pushed toward the bottom face 22 of the vertical bar 20 thereby establishing engagement between the embossments 22*a* and recesses (not shown) of the second connector 50. Thus the assembly of the first and second connectors 40, 50 to the mounting bracket 1 is complete as seen in FIG. 4.

The mounting bracket 1 in the first embodiment discloses an assembly which includes a bracket 1 adapted to have a traditional D-sub connector, i.e., the first connector 40, secured to the upper level and a fine-pitch newly developed Ultra SCSI connector, i.e., the second connector 50, retained at the lower level wherein the second connector 50 is installed into the corresponding second receiving space 1*b* in a horizontal direction. Under this arrangement, the second connector 50 can be snugly retained within the second receiving space 1*b* through the vertical restraint defined by the retaining slot 1C between the bottom face 22 of the vertical bar 20 and the tab 32*a*(32*b*) of the horizontal bar 30, and the horizontal restraint implemented by engagement between the embossments 22*a* of the bracket 1 and the corresponding recesses of the second connector 50. With this feature, the whole assembly including the bracket 1 with the first and second connectors 40, 50, can be handled as one piece to be commonly mounted to the mother board. In addition, to each assembly, the second connector 50 is releasably retained to the bracket 1 that allows flexible processing during shipping and manufacturing, i.e., mounting the bracket 1 and the corresponding connectors 40, 50 to the mother board.

Figure 5:
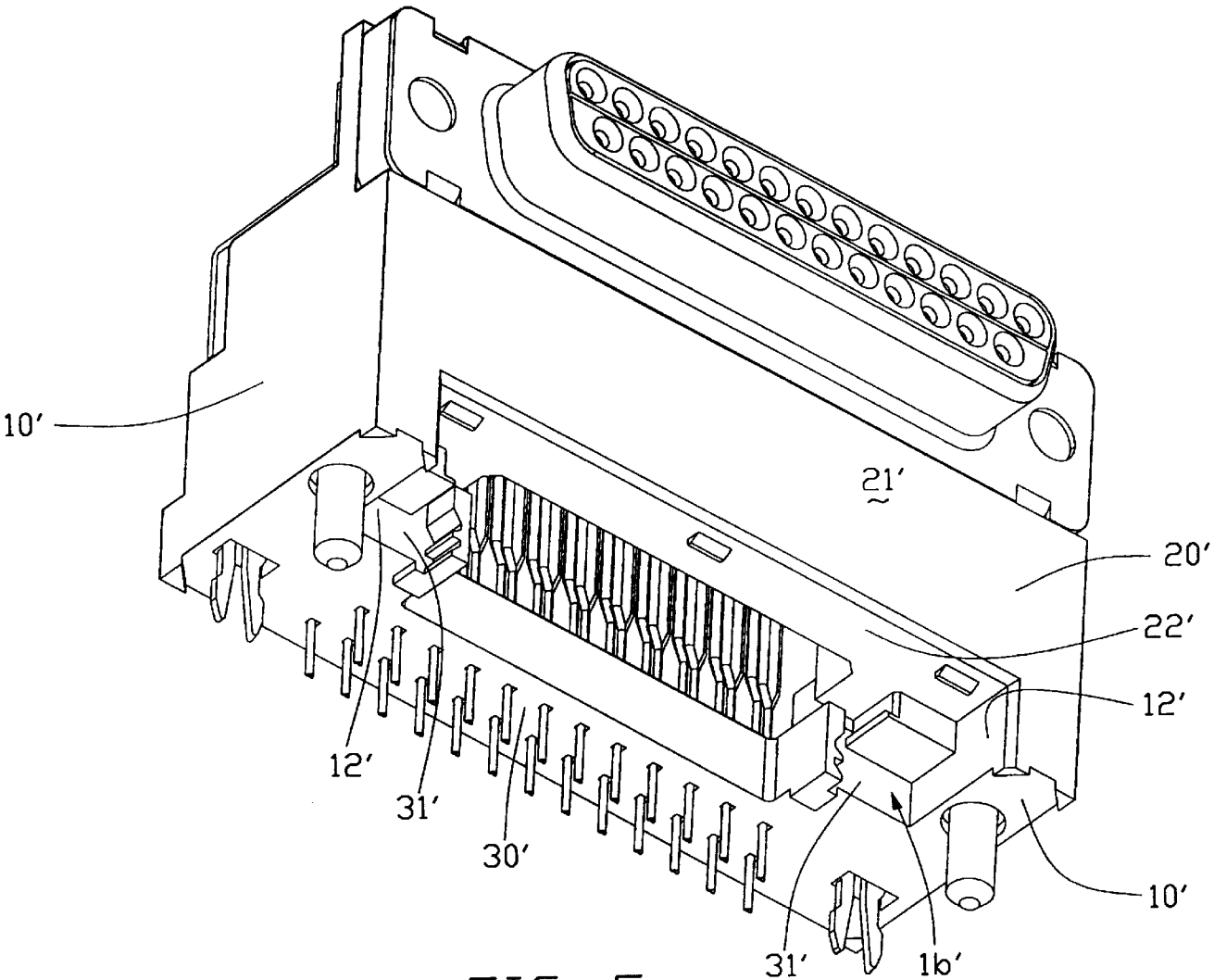
FIG. 5 is a perspective view of a second embodiment of a mounting bracket with a first connector assembled thereto.

FIG. 5 shows a second embodiment of the invention wherein restraint means disclosed in the first embodiment has been removed for flexible compliance with other existing Ultra SCSI connectors which are slightly different from the second connector 50 shown in FIG. 3. Under this situation, the second space 1*b*' is formed by the bottom face 22' of the vertical bar 20', the inner surface 31' of the horizontal bar 30' and the inner wall 12' of the side stand 10'. The second space 1*b*' is defined to have a lateral dimension, between two corresponding inner walls 12' of the two opposite side stands 10', larger than the lateral dimension of the second connector 50 defined by two distal ends 52 thereof (FIG. 3). Similarly, the dimension in a front-to-back direction of the second space 1*b*' which is defined between a front surface 21' of the vertical bar 20' and the inner surface 31' of the horizontal bar 30, is larger than the dimension of the second connector 50 defined between a mating surface 54 and the rear edge 56 thereof (FIG. 3). Therefore, the second connector 50 can be first mounted to the mother board, and then the bracket 1 with the first connector 40 is successively mounted to the mother board wherein the second connector 50 is generally received within the second space 1*b*' with the mating surface 54 is flush with the front surface 21' of the vertical bar 20'. The bracket 1 with the first connector 40 and the associated second connector 50 received within the second space 1*b*' on the mother board, is also similar, in an appearance, to the whole combined assembly as shown in FIG. 4.

It can be seen that the bracket 1 has its own posts 13 and board locks 43 on the side stands 10 while the second connector 50, i.e., the lower connector, also has its own posts 58 (FIG. 3). This provides flexible arrangement for mounting to the mother board with either fully pre-assembled unit as shown in the first embodiment or partially pre-assembled unit as shown in the second embodiment. Regardless of how the assembly is arranged, the invention is to provide a method by using a bracket to mounting a conventional regular pitch connector stacked on a fine pitch connector commonly to a mother board.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. A mounting bracket for assembling connectors, comprising:

a body including a pair of side stands connected between a vertical bar and a horizontal bar, a bottom face of said vertical bar forming at least an embossment extending into said second receiving space for detachably engaging with a recess of said second connector, an anti-disorientation device extending from a wall of said horizontal bar for ensuring correct insertion of said second connector;

a pair of mounting lugs each extending upward from said side stands and defining a first receiving space with a top face of said vertical bar for receiving a first connector therein;

a second receiving space for receiving a second connector being defined between said bottom face of said vertical bar and an inner wall of said horizontal bar; and a retaining slot defined between said anti-disorientation device and said vertical bar for retaining a portion of said second connector.

2. A mounting bracket as recited in claim 1, wherein each mounting lug defines a through hole for riveting said first connector thereto.

3. A mounting bracket as recited in claim 1, wherein at least a post extends downward from a bottom face of said side stands for alignment with a mounting hole of a motherboard.

4. A mounting bracket as recited in claim 1, wherein said side stand defines a passage through which a board lock of said first connector extends.

5. A mounting bracket as recited in claim 1, wherein said horizontal bar includes an array of through holes each aligning with a corresponding contact tail of said first connector.

6. A mounting bracket for assembling connectors, comprising:

a body including a pair of side stands connected between a vertical bar and a horizontal bar, an anti-disorientation device extending from a wall of said horizontal bar for ensuring correct insertion of said second connector;

a pair of mounting lugs each extending upward from said stands and defining a first receiving space with a top face of said vertical bar for receiving a first connector therein, each stand defining a post extending downward from a bottom face thereof for alignment with a mounting hole of a motherboard, a passage being defined in said stand through which a board lock extends, said horizontal bar defining an array of through holes for receiving contact tails of said first connector;

a second receiving space for receiving a second connector being defined between said bottom face of said vertical bar and an inner wall of said horizontal bar; and a retaining slot defined between said anti-disorientation device and said vertical bar for retaining a portion of said second connector.

7. A mounting bracket as recited in claim 6, wherein a bottom face of said vertical bar forms at least an embossment extending into said second receiving space for detachably engaging with a recess of said second connector.

* * * * *